United States Patent [19]

Nozaki et al.

[11] Patent Number: 4,711,591

[45] Date of Patent: Dec. 8, 1987

[54] PRINTER FOR PRINTING BY INK TRANSFER

[75] Inventors: Mineo Nozaki, Kawasaki; Osamu Asakura, Tokyo, both of Japan

[73] Assignee: Canon Kabushiki Kaisha, Tokyo, Japan

[21] Appl. No.: 828,591

[22] Filed: Feb. 10, 1986

Related U.S. Application Data

[63] Continuation of Ser. No. 624,797, Jun. 26, 1984, abandoned, which is a continuation of Ser. No. 515,431, Jul. 18, 1983, abandoned, which is a continuation of Ser. No. 275,407, Jun. 18, 1981, abandoned.

[30] Foreign Application Priority Data

Jun. 30, 1980 [JP] Japan ..... 55-88708
Jun. 30, 1980 [JP] Japan ..... 55-88709

[51] Int. Cl.[4] ..... B41J 33/32

[52] U.S. Cl. ..... 400/225; 400/120; 400/229

[58] Field of Search ..... 400/120, 225, 303, 304, 400/306, 121, 229

[56] References Cited

U.S. PATENT DOCUMENTS

| | | | |
|---|---|---|---|
| 3,855,448 | 12/1974 | Hanagata et al. | 400/120 X |
| 3,872,960 | 3/1975 | Gabor | 400/225 X |
| 4,050,563 | 9/1977 | Menhennett | 400/124 |
| 4,226,546 | 10/1980 | Hoffman | 400/144.2 |
| 4,264,224 | 4/1981 | Mathews | 400/208 X |
| 4,279,390 | 7/1981 | Wu | 400/208 X |
| 4,326,813 | 4/1982 | Lomicka | 400/306 X |
| 4,343,012 | 8/1982 | Knapp | 400/279 X |

*Primary Examiner*—Paul T. Sewell

*Attorney, Agent, or Firm*—Fitzpatrick, Cella, Harper & Scinto

[57] ABSTRACT

There is disclosed an ink transfer printer in which an ink transfer ribbon is displaced in synchronization with the printing head under electric control to achieve high reliability with a simple mechanism.

8 Claims, 4 Drawing Figures

PRINTER FOR PRINTING BY INK TRANSFER

This application is a continuation of application Ser. No. 624,797 filed June 26, 1984, now abandoned, which in turn is a continuation application of Ser. No. 515,431, filed July 18, 1983, now abandoned, which in turn is a continuation of application Ser. No. 275,407, filed June 18, 1981, now abandoned.

BACKGROUND OF THE INVENTION

1. Field of the Invention

The present invention relates to a printer for printing by ink transfer onto a printing sheet from a transfer material containing ink.

2. Description of the Prior Art

A conventional thermal transfer printing system, in which a thermal printing head is successively displaced to perform printing onto a printing sheet through a transfer tape, requires a complicated apparatus because of the use of power limiting mechanisms such as mechanical one-way clutch or frictional clutch for achieving accurate drive of transfer tape, thus leading to unacceptable reliability and a relatively short service life of the apparatus.

SUMMARY OF THE INVENTION

In consideration of the foregoing, the object of the present invention is to provide a printer having a transfer material drive of a simpler structure.

Another object of the present invention is to provide a printer for achieving printing onto a printing sheet through a transfer material by successive displacement of a printing head, wherein the displacement of the transfer material is synchronized with the displacement of the printing head.

Still another object of the present invention is to provide a printer having a transfer type drive device capable of achieving a highly reliable and stable drive under electric control, without power limiting mechanisms such as power transmission mechanisms, an one-way clutch or a frictional clutch.

Still another object of the present invention is to provide a printer capable of achieving clear printing by displacement of transfer material synchronized with the displacement of printing head.

Still other objects and features of the present invention will be made apparent from the following description of the embodiments thereof to be taken in conjunction with the attached drawings.

DESCRIPTION OF THE PREFERRED EMBODIMENTS

Figure 1:
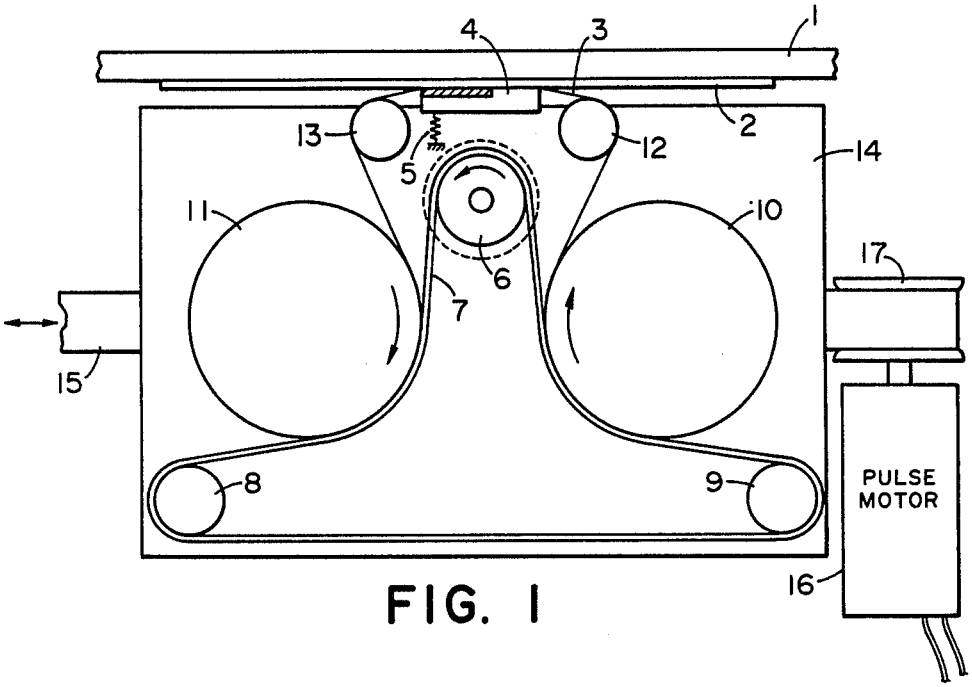
FIG. 1 is a plan view of an embodiment of the present invention.
Figure 2:
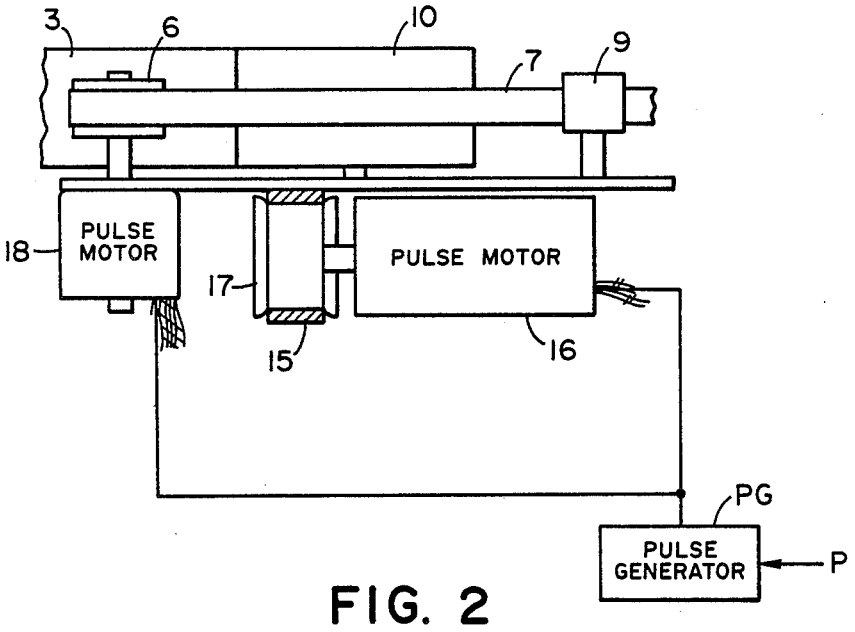
FIG. 2 is a cross-sectional view of the embodiment shown in FIG. 1.

In FIG. 1 showing an embodiment of the present invention, there are shown a fixed platen 1, a printing sheet 2, a transfer tape 3 composed of a transfer material containing thermo-fusible ink, a thermal head 4 maintained in pressure contact with the platen 1 through the transfer tape 3 and the printing sheet 2 by means of a spring 5, a drive roller 6 for driving a tension belt 7 which in turn drives the transfer tape 3, idler rollers 8, 9 for supporting said tension belt 7, a supply reel 10 and a take-up reel 11 for feeding and taking up, respectively, the transfer tape 3 with both reels maintained in pressure contact with the tension belt 7 and driven by said belt 7, guide rollers 12, 13 for guiding the transfer tape supplied from the supply reel 10 and taken up by the take-up reel 11. There is also shown a carriage 14 for supporting the foregoing components except said platen 1 and printing sheet 2, a drive belt 15 having teeth and provided parallel to the platen 1, and a stepping motor 16 for driving a gear 17 meshing with the teeth of said drive belt 15 to rotate said belt 15. The carriage 14 is driven parallel to the platen 1 by the drive belt 15. As shown in the cross-sectional view in FIG. 2, the drive roller 6 is connected with and driven by a stepping or pulse motor 18. A motor control circuit PG generates pulses for driving the stepping or pulse motors 16, 18 in response to a print instruction P. In the present embodiment, the pulses for driving the carriage 14 are also supplied for driving the stepping motor 18 for displacing the transfer tape 3.

The above-explained embodiment functions in the following manner. In response to a print instruction P the motor control circuit PG for controlling the displacement of the thermal head 4 supplies drive pulses to the stepping motor 16, of which rotation is transmitted through the gear 17 and the drive belt 15 to displace the carriage 14 and the thermal head 4 in a direction parallel to the platen 1, thus achieving printing. The drive pulses supplied to said stepping motor 16 are also supplied to the pulse motor 18, of which rotation is transmitted through the drive roller 6 to the tension belt 7, thereby rotating the take-up reel 11 and supply reel 10 maintained in contact therewith and thus advancing the transfer tape 3 from the supply reel 10 to the take-up reel 11 through the guide roller 12, thermal head 4 and guide roller 13 in synchronization with the displacement of the carriage 14. The tension belt 7 is provided with such appropriate elasticity to provide the transfer tape on the take-up reel 11 and supply reel 10 with suitable rotary force. Consequently, despite the displacement of the carriage, the transfer tape 3 has no relative speed to the printing sheet, thus allowing clear printing by the thermal head 4. At the returning stroke of the carriage 14 to the print start position by the reverse rotation of the pulse motor 16, the drive pulses are not supplied to the pulse motor 18 whereby the drive roller 6 is at a standstill. Thus the transfer tape 3 is not advanced and is returned to the stand-by position without rubbing the printing sheet 2 since the thermal head in this state is separated from the printing sheet.

In this manner, in contrast to the conventional mechanism in which the rotation in one direction is obtained by a mechanical device such as a one-way clutch or a frictional clutch by the reciprocating motion of the carriage, the drive, take-up and tensioning mechanisms in the present invention are significantly simplified to the combination of a pulse motor and a belt controlled electrically.

As explained in the foregoing, the present invention allows drive, supply and take-up of the transfer tape completely synchronized with the displacement of the carriage under an electric control, which is in place of a complicated mechanical control, thus providing a printer equipped with a highly reliable and stable transfer tape drive device with a prolonged service life.

Figure 3:
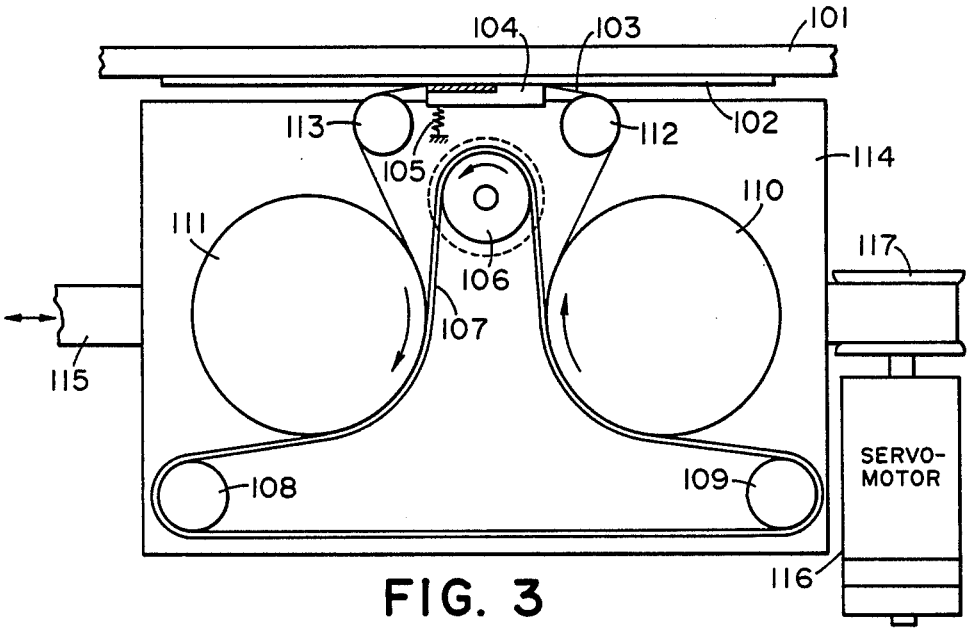
FIG. 3 is a plan view showing another embodiment of the present invention.

FIG. 3 is a plan view showing another embodiment of the present invention, wherein there is shown a fixed platen 101, a printing sheet 102, a transfer tape 103 composed of a transfer material containing thermo-fusible ink, a thermal head 104 maintained in pressure contact with the platen 101 through the transfer tape 103 and the transfer sheet 102 by means of a spring 105, a drive roller 106 for driving a tension belt 107 which in turn drives the transfer tape 103, idler rollers 108, 109 for supporting said tension belt 107, a supply reel 110 and a take-up reel 111 for feeding and taking up, respectively, the transfer tape 103 with both reels maintained in pressure contact with the tension tape 107 and driven by said tape 107, guide rollers 112, 113 for guiding the transfer tape supplied from the supply reel 110 and taken up by the take-up reel 111. There is also shown a carriage 114 for supporting the aforementioned components except said platen 101 and printing sheet 102, a drive belt 115 having teeth and provided parallel to the platen 101, and a servomotor 116 for driving a gear 117 meshing with the teeth of said drive belt 115 to rotate the same. The carriage 114 is driven parallel to the platen 101 by the drive belt 115. As shown in the cross-sectional view in FIG. 4, the drive roller 106 is connected with and driven by a stepping or pulse motor 118.

Revolution detectors 119, 120, which are mounted on the shaft of said servomotor 116, detect the position of the carriage 114 by the rotation of said servomotor 116, and release the positional information. Said revolution detectors 119, 120 are utilized for controlling the print position of the upper-case or large characters and lower-case or small characters, respectively. A circuit 121 generates pulse signals to be supplied to the pulse motor 118, in response to the positional information from the revolution detector 119. Another control circuit 122 supplies a voltage for driving the servomotor 116 in response to the print instruction P, and, in response to a size information SIZE, control a switch 123 which selects the positional information from the revolution detector 119 or 120 as print timing signal for the printing head 104.

Figure 4:
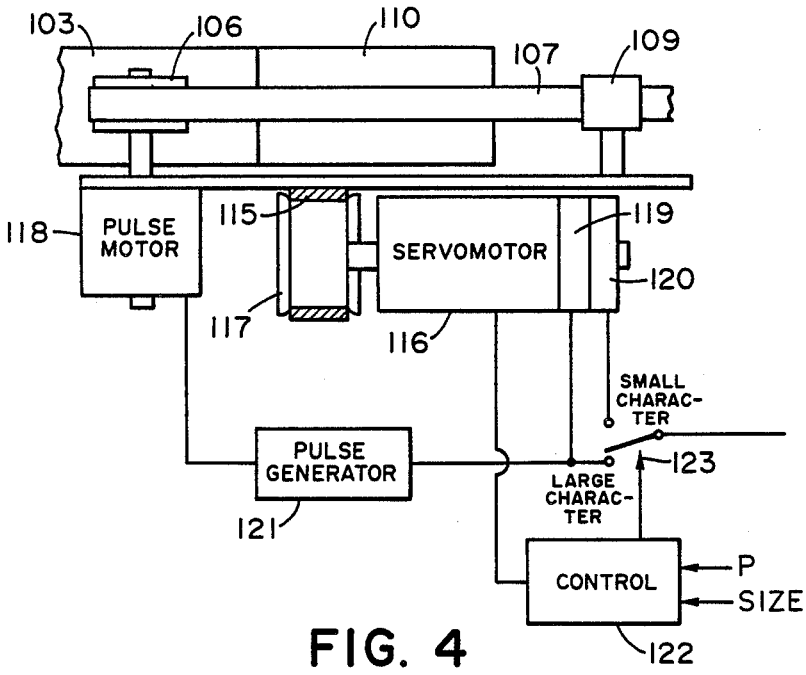
FIG. 4 is a cross-sectional view of the embodiment shown in FIG. 3.

The above-explained embodiment functions in the following manner. In response to the print instruction P, the control circuit 122 for displacing the thermal head 104 supplies a voltage to the servomotor 116, of which rotation is transmitted through the gear 117 and drive belt 115 to displace the carriage 114 and thermal head 104 in a direction parallel to the platen 101, whereby the printing operation is achieved while the position of the carriage 114 is detected by the revolution detector 119. The pulses from the revolution detector 119 corresponding to the positional detection are supplied to the pulse motor 118 to drive the tension belt 107 through the drive roller 106. In this manner the take-up reel 111 and supply reel 110 maintained in contact with said tension belt 107 are rotated to advance the transfer tape 103 from said supply reel 110 to the take-up reel 111 through the tape guide roller 112, thermal head 104 and guide roller 113, in synchronization with the displacement of the carriage 114. The tension belt 107 is provided with such appropriate elasticity to provide the transfer tape on the take-up reel 111 and supply reel 110 with a suitable rotary force. Thus, despite the displacement of the carriage 114, the transfer tape 103 has no relative speed to the printing sheet 102, thereby allowing clear printing by the thermal head 104. In case of changing the size of printed characters for example from the upper-case characters to the lower-case ones by suitably selecting the dots of the thermal head 104, the position detecting pulses are obtained from the revolution detector 120 with a smaller pitch of positional detection instead of the revolution detector 119 as shown in FIG. 4. However said pulses, if supplied to the pulse motor 118 for driving the transfer tape 103 through the drive roller 106, will break the synchronized displacement of the transfer tape 103 to the printing sheet 102 achieved by the pulses from the revolution detector 119, leading to a mutual displacement, and therefore relative speed with respect to each other, between said tape 103 and the printing sheet 102 and forbidding clear printing. For this reason, independent of the change-over to the print position signals obtained from the revolution detector 120 from those of the detector 119 as shown in FIG. 4, the pulse motor 118 for advancing the transfer plate 103 continues to receive the position signals from said detector 119, thus maintaining the synchronized displacement between the transfer tape 103 and the carriage 114 to maintain no relative speed between the transfer tape 102 and printing sheet 103, thereby enabling clear printing. At the returning stroke of the carriage 114 to the print start position by the inverse rotation of the servomotor 116, the pulse motor 118 does not receive the drive pulses and the transfer tape 103 is at a standstill and does not rub the printing sheet 102 as the thermal head 104 is separated from the printing sheet in this state.

In this manner, in contrast to the conventional mechanism in which the rotation in one direction is obtained by a mechanical device such as an one-way clutch or a frictional clutch by the reciprocating motion of the carriage, the drive, take-up and tensioning mechanisms in the present invention are significantly simplified to the combination of pulse motor and a belt controlled electrically.

As explained in the foregoing, the printer of the present invention having a drive mechanism for thermal transfer tape allows the drive, supply and take-up of the transfer tape completely synchronized with the displacement of the carriage under electric control in place of complicated mechanical control, by employing determined position signals for driving the transfer tape even in the presence of varied position signals to be supplied to the thermal head for modifying the print positions for example for upper-case and lower-case characters, thereby providing a highly reliable and stable transfer tape drive mechanism with prolonged service life.

What we claim is:

1. A printer for printing on a printing medium with ink coated on a support material, said printer comprising:

a print head for transferring ink onf the support material onto the printing medium by the heat of said print head;

a carriage having said print head mounted thereon, said carriage being disposed for movement in the direction of a print line;

a first motor for moving said carriage in the direction of the print line, said first motor including print signal generating means for generating two types of signals;

a second motor mounted on said carriage for feeding the support material;

driving signal generating means for generating driving signals to be supplied to said first motor and said second motor, said driving signal generating means including control means responsive to one of the two types of signals from said print signal generating means for providing a driving signal to said second motor; and feeding means mounted on said carriage, said feeding means being operative in response to said control means for causing said second motor to feed the support material by the same amount as the movement of said carriage.

2. A printer according to claim 1, wherein said second motor includes a pulse motor.

3. A printer according to claim 1, wherein said first motor includes a pulse motor.

4. A printer according to claim 1, further comprising switching means for selecting one of the two types of signals from said print signal generating means to control the print timing of said print head.

5. A printer according to claim 1, wherein said feeding means includes a belt member for feeding the support material.

6. A printer according to claim 1, wherein said carriage includes supply means for supplying the support material and take-up means for taking up the support material.

7. A printer according to claim 6, wherein said feeding means is located midway between said supply means and said take-up means and said belt member comes into contact with the support material.

8. A printer according to claim 1, wherein said second motor is positioned relative to said carriage to drive a roller disposed at a position opposite to said print head mounted on said carriage.

* * * * *

UNITED STATES PATENT AND TRADEMARK OFFICE

CERTIFICATE OF CORRECTION

PATENT NO. : 4,711,591

DATED : December 8, 1987

INVENTOR(S) : MINEO NOZAKI, ET AL.

It is certified that error appears in the above-identified patent and that said Letters Patent is hereby corrected as shown below:

COLUMN 1

Line 41, "an" should read --a--.
Line 50, "attached" should read --accompanying--.

COLUMN 3

Line 35, "A circuit" should read --A control circuit--.
Line 41, "control" should read --controls--.

COLUMN 4

Line 34, "an" should read --a--.
Line 57, "onf" should read --on--.

Signed and Sealed this

Tenth Day of May, 1988

*Attest:*

*Attesting Officer*

DONALD J. QUIGG

*Commissioner of Patents and Trademarks*